US005350107A

United States Patent [19]

Wright et al.

[11] Patent Number: 5,350,107

[45] Date of Patent: Sep. 27, 1994

[54] IRON ALUMINIDE ALLOY COATINGS AND JOINTS, AND METHODS OF FORMING

[75] Inventors: Richard N. Wright; Julie K. Wright; Glenn A. Moore, all of Idaho Falls, Id.

[73] Assignee: EG&G Idaho, Inc., Idaho Falls, Id.

[21] Appl. No.: 118,864

[22] Filed: Sep. 8, 1993

Related U.S. Application Data

[63] Continuation-in-part of Ser. No. 603,650, Oct. 26, 1990, Pat. No. 5,269,830.

[51] Int. Cl.[5] ..... B23K 20/00; B23K 31/00

[52] U.S. Cl. ..... 228/198; 228/245; 228/248.5; 228/262.43; 228/122.1; 427/191

[58] Field of Search ..... 228/198, 245, 246, 248.5, 228/262.43, 122.1; 427/191, 192

[56] References Cited

U.S. PATENT DOCUMENTS

| | | | |
|---|---|---|---|
| 3,998,779 | 12/1976 | Baer | 523/457 |
| 4,004,047 | 1/1977 | Grisik | 427/142 |
| 4,711,009 | 12/1987 | Cornelison | 29/890 |
| 5,084,109 | 1/1992 | Sikka | 148/12 R |

OTHER PUBLICATIONS

Wright, R. N. et al, "Elemental Powder Processing of Iron Aluminides," *American Powder Metallurgy Institute Proceedings,* Dec., 1992

*Primary Examiner*—Samuel M. Heinrich

*Attorney, Agent, or Firm*—Wells, St. John, Roberts, Gregory & Matkin

[57] ABSTRACT

A method of joining two bodies together, at least one of the bodies being predominantly composed of metal, the two bodies each having a respective joint surface for joining with the joint surface of the other body, the two bodies having a respective melting point, includes the following steps: a) providing aluminum metal and iron metal on at least one of the joint surfaces of the two bodies; b) after providing the aluminum metal and iron metal on the one joint surface, positioning the joint surfaces of the two bodies in juxtaposition against one another with the aluminum and iron positioned therebetween; c) heating the aluminum and iron on the juxtaposed bodies to a temperature from greater than or equal to 600° C. to less than the melting point of the lower melting point body; d) applying pressure on the juxtaposed surfaces; and e) maintaining the pressure and the temperature for a time period effective to form the aluminum and iron into an iron aluminide alloy joint which bonds the juxtaposed surfaces and correspondingly the two bodies together. The method can also effectively be used to coat a body with an iron aluminide coating.

41 Claims, No Drawings

IRON ALUMINIDE ALLOY COATINGS AND JOINTS, AND METHODS OF FORMING

CONTRACTUAL ORIGIN OF THE INVENTION

EG&G Idaho, Inc. has rights in this invention pursuant to Contract No. DE-ACO7-76ID01570 between the United States Department of Energy and EG&G Idaho, Inc.

RELATED PATENT DATA

This patent resulted from a continuation-in-part application of U.S. patent application Serial No. 07/603,650, filed on Oct. 26, 1990, and entitled "Process for Synthesizing Compounds from Elemental Powders", which issued as U.S. Pat. No. 5,269,830.

TECHNICAL FIELD

This invention relates to iron aluminide alloys.

BACKGROUND OF THE INVENTION

Intermetallic iron aluminide alloys, such as $Fe_3Al$, have been of long-standing interest because of their excellent abrasive wear resistance, corrosion and sulfidation resistance, oxidation resistance and resistance to cavitation erosion. Application of ion aluminides in industry has been hampered by brittle behavior at room temperature and insufficient strength at elevated temperature. However, some advances in alloy development and processing have somewhat improved ductility and elevated temperature strength.

Conventional methods of processing iron aluminides, such as $Fe_3Al$, include casting, hot rolling, and powder metallurgical processing. A recently developed alternative processing method is reactive sintering. Here, reactive sintering or self-propagating high temperature synthesis is utilized. The advantages of reactive sintering include inexpensive and easily compacted powder starting materials, low processing temperatures, and flexibility in composition and micro-structure control, including the ability to incorporate particulate reinforcements. The process uses an exothermic reaction between elemental powders to form the intermetallic by the reaction:

$$3Fe+Al>Fe_3Al$$

During heating of elemental powder compacts, compound formation occurs initially by solid state reaction at interparticle contacts. This process causes local heating due to an exothermic reaction and results in localized liquid formation. The presence of the aluminum-rich liquid causes a rapid increase in the reaction rate and the heat evolved causes further liquid formation. The speed of the overall process suggests that melt formation and spreading, accompanied by exothermic heating, controls the reaction rate. Compound formation occurs by precipitation from the liquid as the liquid front advances outward from the original aluminum particle sites.

Combustion synthesis of $Fe_3Al$ is somewhat difficult: swelling of compacts accompanying reaction synthesis has been reported. Careful selection of the relative particle sizes, green density and heating rate can result in densification compared to the green state. However, the application of pressure is apparently required to achieve full density. It has been found that the typical added elemental Cr does not dissolve into solution during the formation of Cr-enhanced $Fe_3Al$ by combustion synthesis. A solution treatment of several hours is required to homogenize the material after formation of the compound. If the solution treatment is carried out subsequent to consolidation, Kirkendall pores result at the prior sites of the Cr particles. It is therefore desirable to react the powders and homogenize the material prior to consolidation, or maintain the pressure while holding the material at a temperature well above that necessary to carry out the synthesis reaction to allow dissolution of the Cr.

Example methods of forming iron aluminides are shown in Knibloe, et al., "Microstructure and Mechanical Properties of P/M $Fe_3Al$ Alloys", *Advances in Powder Metallurgy,* Vol. 2, pp. 219–231 (1990), Diehm, et al., "Processing and Alloying of Modified Iron Aluminides", *Materials & Manufacturing Processes* #4(1), pp. 61–72 (1989); Sheasby, J. S., "Powder Metallurgy of Iron-Aluminum", *The International Journal of Powder Metallurgy & Powder Technology,* Vol. 15, No. 4, pp. 301–305 (1979); Rabin, et al., "Microstructure and Tensile Properties of $Fe_3Al$ Produced by Combustion Synthesis/Hot Isostatic Pressing", *Metallurgical Transactions A,* Vol. 23A, pp. 35–40 (1992); and Rabin, et al., "Synthesis of Iron Aluminides from Elemental Powders: Reaction Mechanisms and Densification Behavior", *Metallurgical Transactions A,* Vol. 22A, pp. 277–286 (1991). These references are hereby incorporated by reference.

As new and improved materials are developed, methods of joining the material to itself and other materials must be developed. Some progress has been made in joining iron aluminide alloys, such as shown in S. A. David, et al., *Welding Journal,* 68 (9), 372s (1989) and T. Zacharia, et al., *Proceedings of the Fifth Annual Conference on Fossil Energy Materials,* p. 197, Oak Ridge, Tenn., (May 1991). Iron aluminide alloys may as well find uses beyond those presently contemplated in the prior art.

DETAILED DESCRIPTION OF THE PREFERRED EMBODIMENTS

This disclosure of the invention is submitted in furtherance of the constitutional purposes of the U.S. Patent Laws "to promote the progress of science and useful arts" (Article 1, Section 8).

In accordance with one aspect of the invention, a method of joining two bodies together, at least one of the bodies being predominantly composed of metal, with the two bodies each having a respective joint surface for joining at the joint surface of the other body, and with the two bodies having a respective melting point, comprises the following steps:

providing aluminum metal and iron metal on at least one of the joint surfaces of the two bodies;

after providing the aluminum metal and iron metal on the one joint surface, positioning the joint surfaces of the two bodies in juxtaposition against one another with the aluminum and iron positioned therebetween;

heating the aluminum and iron on the juxtaposed bodies to a temperature from greater than or equal to 600° C. to less than the melting point of the lower melting point body; and maintaining the temperature for a time period effective to form the aluminum and iron into an iron aluminide alloy joint which bonds the juxtaposed surfaces and correspondingly the two bodies together.

In the context of this document, the word "metal" is defined as any of a group of substances that typically show a characteristic luster, are good conductors of electricity and heat, are opaque and can be fused, and occur in elemental, alloy or intermetallic form.

Preferably, pressure is applied on the two bodies to apply pressure on the juxtaposed surfaces during heating, with pressure being maintained during formation of the joint. Pressureless joining is expected to accomplish adequate joint formation, but require significantly longer curing times. Where pressure is applied, the preferred pressure is from about 10 MPa to 200 MPa.

The above described techniques are usable in joining two same material metal bodies together, joining two dissimilar metal bodies together having different melting points, or joining a metal body to a non-metal body such as a ceramic. In the context of this document, a ceramic is defined as any solid material composition which is neither metallic nor organic. Examples would include joining two same or different metal bodies to one another, including of course, bodies formed of iron aluminide alloys.

Typically and preferably, the aluminum and iron metals provided on at least one of the joint surfaces will be in elemental form. Alternately by way of example only, iron or aluminum alloys might be utilizable in producing iron aluminide joints. The aluminum and iron metals would be provided on the joint surface in selected stoichiometric ratios to produce a desired iron aluminide alloy, such as either $Fe_3Al$ or FeAl. The aluminum and iron metals might be provided on the joint surface in powder form, preferably homogeneously premixed, or on the joint surface in the form of separate metal foils. Further by way of example, the iron and aluminum metal might be provided on the joint surface in the form of a homogeneous polymer bound sheet. For example, iron and aluminum metal powders in a desired stoichiometric ratio might be combined with a polymer precursor such as polyvinyl butyrol, and processed to form a polymer sheet having iron and aluminum homogeneously distributed thereout in the desired stoichiometric ratio.

In accordance with another aspect of the invention, a method of alloy coating a body with an iron aluminide alloy comprises the following steps:

providing aluminum metal and iron metal on a surface of the body to be alloy coated;

heating the aluminum and iron to a temperature from greater than or equal to 600° C. to less than the melting point of the body; and maintaining the temperature for a time period effective to form the aluminum and iron into an iron aluminide alloy which adheres to and coats the surface.

Preferably, pressure is as well applied against the coating during temperature cure. Where pressure is applied, 10 MPa to 200 MPa is preferred. Conditions and quantities of providing the powder against the surface being coated would be as described above with respect to the joining two bodies method. Preferred thickness of the finished coating is anywhere from about 1 micron to 10,000 microns.

EXPERIMENTAL PROCEDURE

Carbonyl iron powder with an average particle size of 8 micron (GAF Corp., Wayne, N.J.) was mixed in the appropriate ratio with helium gas atomized aluminum powders (Valimet, Inc., Stockton, Calif.) in all of the experiments. Initial experiments were carried out using 3 micron average diameter aluminum powder. However, agglomeration occurred during mixing that resulted in defects in the consolidated material. Aluminum powder with 10 micron average diameter was used in subsequent experiments and agglomeration was not observed. Binary Fe-28%Al (compositions in atomic percent) and Fe-28%Al with 2% and 5% added Cr were examined. Cr was added to the elemental Fe and Al powders prior to mixing in the form of elemental powder of 1–5 micron diameter (Cerac, Inc., Milwaukee, Wis.).

Appropriate powders were dry-mixed in a shaker-type mixer for one hour and cold isostatically pressed at 27 MPa to a green density of approximately 70%. Consolidation was carried out using uniaxial hot-pressing, HIP, or the Ceracon process.

To make an iron aluminide coating, a layer of the powder mixture, approximately 3 millimeters thick, was uniaxially pressed at 44 MPa onto a substrate consisting of a 5 millimeter thick section of 26 millimeter diameter carbon steel bar stock. Such stock had a rough surface texture resulting from cutting with a band saw. The resulting compact was placed in graphite foil-lined graphite dies of a hot press. Heat was applied under 28 MPa pressure at a rate of 0.3° C./sec. to 1000° C., and held for one hour. The pressure was maintained during cooling as well.

To make joints, the premixed powder described above was uniaxially pressed to form a thin 13 millimeter diameter disk using a pressure of 175 MPa. An Fe-50%Al mixture was also created to form FeAl, which is known to have a higher heat of reaction, and has potential for better bonding. The FeAl powder was similarly mixed and cold pressed. Each of the powder compositions was sandwiched between sol id $Fe_3Al$ hot-extruded material and placed in a graphite fixture with a screw clamp that applied a light load and maintained contact between the layers. The fixture was placed in a furnace and fired under Ar at 0.3° C./sec. to 1200° C. and held for one hour.

To obtain a denser joining layer, a second sandwich of hot-extruded $Fe_3Al$ and compacts of the two elemental powder compositions were reacted while hot-pressing. In this case, the green powder compacts were uniaxially pressed using 525 MPa pressure. The layers were placed in a graphite die, heated under a pressure of 24.5 MPa at a rate of 0.3° C./sec. to 1200° C., and held at pressure and temperature for 15 minutes in an argon atmosphere.

For mechanical testing, a larger $Fe_3Al$ joint was made with 2% Cr to increase the potential ductility. A pressure of 20.7 MPa was applied at 500° C., after which the sample was heated at a rate of 0.08° C./sec to 1100° C. and held for 1 h to homogenize the Cr. The sample was cut into 3×4×30 mm bars, with the joint in the center, for bend testing.

In another study, Mg, B and P were used as sintering aids in an effort to obtain dense $Fe_3Al$ and FeAl without the use of pressure. The Al-Fe elemental mixtures were coated with an aqueous magnesium acetate solution to achieve 0.3 wt % Mg. The coated powder was dried at 85° C., deagglomerated using a mortar and pestle, and uniaxially pressed at 525 MPa to form 13 mm diameter compacts. The compacts were heated in a furnace at 0.3° C./sec to 1200° C. and held for 1 hour in Ar. Similarly, doping levels of 1 wt % B and P were obtained from boric acid, $H_3BO_3$, and phosphoric acid, $H_3PO_4$.

RESULTS AND DISCUSSION

The hot pressed $Fe_3Al$ coating had a fine grain structure of about 5 μm. A reaction zone formed in the carbon steel substrate below the coating. Energy dispersive spectroscopy (EDS) in the scanning electron microscope (SEM) showed an Al content of 11 at% in this region, indicating that Al diffused from the coating into the steel. It is likely that C diffused into the coating material as well, although measurements were not made. The absence of pearlite in the reaction zone may indicate carbon diffusion. Interdiffusion increases the likelihood of good bonding. A micro-hardness profile taken across the coating interface showed a smooth transition from 390 DPH in the aluminide coating to 197 DPH at the interface and 153 DPH in the steel.

X-ray diffraction indicated that the coating was primarily $DO_3$ ordered $Fe_3Al$ with some of the ternary carbide $AlFe_3C_{0.5}$. This ternary phase has been detected previously in combustion synthesized $Fe_3Al$, where it was concluded that the carbonyl iron powder had sufficient retained carbon to form the carbide phase. The volume fraction of carbide measured at the outside surface of the coating was greater than previously found, and was thought to be the result of using graphite foil to line the hot press fixture.

The joints produced with nominal applied pressure were intact and withstood the grinding required for metallographic observation, but had a high level of porosity. In contrast, the hot-pressed $Fe_3Al$ joints were near theoretical density and consisted of 10 to 15 μm equiaxed grains. The FeAl hot-pressed joint was slightly more porous and had a grain size of 5 to 10 μm. Backscattered SEM of the hot pressed joints showed a gradient of Al from the richer FeAl layer to the surrounding $Fe_3Al$, indicating Al diffusion.

The Cr-containing $Fe_3Al$ joint had the same small equiaxed grains with 30–50 μm second phase particles, identified as oxides by EDS in the SEM. Significant plasticity was observed in four-point bend testing. As a result, strength calculations could not be made for this configuration. However, a three-point bend test resulted in failure at the extrusion/SHS material interface at a strength of 1580 MPa, about the same as the tensile fracture strength of the extruded material. This value should be improved when a more homogeneous microstructure is obtained.

The reaction to form $Fe_3Al$ from the constituent metal powders self-propagates once the melting point of Al has been reached. Therefore, the oxide layer on the aluminum particles can inhibit the formation of $Fe_3Al$. Magnesium has previously been found by others to have a significant effect on oxidation characteristics of aluminum powder during sintering. MgO has a lower free energy of formation than $Al_2O_3$, and therefore promotes the reduction of the oxide surface layer on the Al particles during heating. Others have found that B and P additions resulted in higher densities and strengths in sintered Fe compacts by forming a lower melting phase. However, the porosity of combustion synthesized Mg-doped $Fe_3Al$ pellets was higher than that of undoped $Fe_3Al$ samples. The phosphorous-doped specimen appeared to have a microstructure similar to that of the Mg-doped material, although the grain size was slightly coarser. $Fe_3Al$ compacts containing boron had large, 50 μm diameter, round grain aggregates throughout the sample, in addition to large pores. Thus, Mg, B and P doping at low levels all had a detrimental effect on the overall densification of the $Fe_3Al$.

In compliance with the statute, the invention has been described in language more or less specific as to structural, compositional and methodical features. It is to be understood, however, that the invention is not limited to the specific features described, since the means herein disclosed comprise preferred forms of putting the invention into effect. The invention is, therefore, claimed in any of its forms or modifications within the proper scope of the appended claims appropriately interpreted in accordance with the doctrine of equivalents.

We claim:

1. A method of joining two bodies together, at least one of the bodies being predominantly composed of metal, the two bodies each having a respective joint surface for joining with the joint surface of the other body, the two bodies having a respective melting point, the method comprising the following steps:

providing aluminum metal and iron metal on at least one of the joint surfaces of the two bodies;

after providing the aluminum metal and iron metal on the one joint surface, positioning the joint surfaces of the two bodies in juxtaposition against one another with the aluminum and iron positioned therebetween;

heating the aluminum and iron on the juxtaposed bodies to a temperature from greater than or equal to 600° C. to less than the melting point of the lower melting point body;

applying pressure on the juxtaposed surfaces; and maintaining the pressure and the temperature for a time period effective to form the aluminum and iron into an iron aluminide alloy joint which bonds the juxtaposed surfaces and correspondingly the two bodies together.

2. The method of joining two bodies together of claim 1 wherein the applied pressure is from about 10 MPa to 200 MPa.

3. The method of joining two bodies together of claim 1 wherein the aluminum and iron metals are provided in a selected s stoichiometric ratio on the joint surface, the stoichiometric ratio being effective to produce an iron aluminide alloy joint predominantly comprising $Fe_3Al$.

4. The method of joining two bodies together of claim 1 wherein the aluminum and iron metals are provided in a selected s stoichiometric ratio on the joint surface, the stoichiometric ratio being effective to produce an iron aluminide alloy joint predominantly comprising FeAl.

5. The method of joining two bodies together of claim 1 wherein the aluminum metal and iron metal are provided on the joint surface in powder form.

6. The method of joining two bodies together of claim 1 wherein the aluminum metal and iron metal are provided on the joint surface in a form of separate metal foils.

7. The method of joining two bodies together of claim 1 wherein the aluminum metal and iron metal are provided on the joint surface in a form of a homogenous polymer bound sheet.

8. The method of joining two bodies together of claim 1 wherein the aluminum metal and iron metal are provided in elemental form.

9. The method of joining two bodies together of claim 1 wherein at least one of the bodies being joined predominately comprises an iron aluminide.

10. The method of joining two bodies together of claim 1 wherein each body being joined predominately comprises metal.

11. The method of joining two bodies together of claim 1 wherein one of the bodies being joined is a ceramic.

12. The method of joining two bodies together of claim 1 wherein each body being joined predominately comprises an iron aluminide.

13. The method of joining two bodies together of claim 1 wherein the bodies being joined constitute different materials and have different melting points.

14. A method of joining two bodies together, at least one of the bodies being predominantly composed of metal, the two bodies each having a respective joint surface for joining with the joint surface of the other body, the two bodies having a respective melting point, the method comprising the following steps:

providing aluminum metal and iron metal on at least one of the joint surfaces of the two bodies;

after providing the aluminum metal and iron metal on the one joint surface, positioning the joint surfaces of the two bodies in juxtaposition against one another with the aluminum and iron positioned therebetween;

heating the aluminum and iron on the juxtaposed bodies to a temperature from greater than or equal to 600° C. to less than the melting point of the lower melting point body; and maintaining the temperature for a time period effective to form the aluminum and iron into an iron aluminide alloy joint which bonds the juxtaposed surfaces and correspondingly the two bodies together.

15. The method of joining two bodies together of claim 14 wherein the aluminum and iron metals are provided in a selected stoichiometric ratio on the joint surface, the stoichiometric ratio being effective to produce an iron aluminide alloy joint predominantly comprising $Fe_3Al$.

16. The method of joining two bodies together of claim 14 wherein the aluminum and iron metals are provided in a selected stoichiometric ratio on the joint surface, the stoichiometric ratio being effective to produce an iron aluminide alloy joint predominantly comprising FeAl.

17. The method of joining two bodies together of claim 14 wherein the aluminum metal and iron metal are provided in elemental form.

18. The method of joining two bodies together of claim 14 wherein at least one of the bodies being joined predominately comprises an iron aluminide.

19. The method of joining two bodies together of claim 14 wherein each body being joined predominately comprises metal.

20. The method of joining two bodies together of claim 14 wherein one of the bodies being joined comprises a ceramic.

21. The method of joining two bodies together of claim 14 where in each body being joined predominately comprises an iron aluminide.

22. A method of alloy coating a body with an iron aluminide alloy, the body having a melting point, the method comprising the following steps:

providing aluminum metal and iron metal on a surface of the body to be alloy coated;

heating the aluminum and iron to a temperature from greater than or equal to 600° C. to less than the melting point of the body;

applying pressure on the aluminum and iron against the body surface; and maintaining the pressure and the temperature for a time period effective to form the aluminum and iron into an iron aluminide alloy which adheres to and coats the surface.

23. The method of alloy coating a body with an iron aluminide alloy of claim 22 wherein the applied pressure is from about 10 MPa to 200 MPa.

24. The method of alloy coating a body with an iron aluminide alloy of claim 22 wherein the aluminum and iron metals are provided in a selected stoichiometric ratio on the surface, the stoichiometric ratio being effective to produce an iron aluminide alloy coating predominantly comprising $Fe_3Al$.

25. The method of alloy coating a body with an iron aluminide alloy of claim 22 wherein the aluminum and iron metals are provided in a selected stoichiometric ratio on the surface, the stoichiometric ratio being effective to produce an iron aluminide alloy coating predominantly comprising FeAl.

26. The method of alloy coating a body with an iron aluminide alloy of claim 22 wherein the aluminum metal and iron metal are provided on the surface in powder form.

27. The method of alloy coating a body with an iron aluminide alloy of claim 22 wherein the aluminum metal and iron metal are provided on the surface in a form of separate metal foils.

28. The method of alloy coating a body with an iron aluminide alloy of claim 22 wherein the aluminum metal and iron metal are provided on the surface in a form of a homogenous polymer bound sheet.

29. The method of alloy coating a body with an iron aluminide alloy of claim 22 wherein the aluminum metal and iron metal are provided in elemental form.

30. The method of alloy coating a body with an iron aluminide alloy of claim 22 wherein the applied coating has a thickness of from about 1 micron to about 10,000 microns.

31. The method of alloy coating a body with an iron aluminide alloy of claim 22 wherein the body being coated is a metal body.

32. The method of alloy coating a body with an iron aluminide alloy of claim 22 wherein the body being coated is a ceramic body.

33. The method of alloy coating a body with an iron aluminide alloy of claim 22 wherein the body being coated is predominantly composed of an iron aluminide.

34. A method of alloy coating a body with an iron aluminide alloy, the body having a melting point, the method comprising the following steps:

providing aluminum metal and iron metal on a surface of the body to be alloy coated;

heating the aluminum and iron to a temperature from greater than or equal to 600° C. to less than the melting point of the body; and maintaining the temperature for a time period effective to form the aluminum and iron into an iron aluminide alloy which adheres to and coats the surface.

35. The method of alloy coating a body with an iron aluminide alloy of claim 34 wherein the aluminum and iron metals are provided in a selected stoichiometric ratio on the surface, the stoichiometric ratio being effective to produce an iron aluminide alloy coating predominantly comprising $Fe_3Al$.

36. The method of alloy coating a body with an iron aluminide alloy of claim 34 wherein the aluminum and iron metals are provided in a selected stoichiometric ratio on the surface, the stoichiometric ratio being effective to produce an iron aluminide alloy coating predominantly comprising FeAl.

37. The method of alloy coating a body with an iron aluminide alloy of claim 34 wherein the aluminum metal and iron metal are provided in elemental form.

38. The method of alloy coating a body with an iron aluminide alloy of claim 34 wherein the applied coating has a thickness of from about 1 micron to about 10,000 microns.

39. The method of alloy coating a body with an iron aluminide alloy of claim 34 wherein the body being coated is metal body.

40. The method of alloy coating a body with an iron aluminide alloy of claim 34 wherein the body being coated is ceramic body.

41. The method of alloy coating a body with an iron aluminide alloy of claim 34 wherein the body being coated is predominantly composed of an iron aluminide.

* * * * *